US011254550B2

(12) United States Patent
Coles

(10) Patent No.: US 11,254,550 B2
(45) Date of Patent: Feb. 22, 2022

(54) AUTOMATIC WIRE SPOOLING CONTROL

(71) Applicant: Halliburton Energy Services, Inc., Houston, TX (US)

(72) Inventor: Randolph Scott Coles, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 370 days.

(21) Appl. No.: 16/485,705

(22) PCT Filed: Nov. 13, 2018

(86) PCT No.: PCT/US2018/060712

§ 371 (c)(1),
(2) Date: Aug. 13, 2019

(87) PCT Pub. No.: WO2020/101651

PCT Pub. Date: May 22, 2020

(65) Prior Publication Data

US 2021/0323799 A1 Oct. 21, 2021

(51) Int. Cl.
*B66D 1/40* (2006.01)
*B66D 1/60* (2006.01)
(Continued)

(52) U.S. Cl.
CPC ..... *B66D 1/40* (2013.01); *B65H 63/003* (2013.01); *B66D 1/60* (2013.01); *E21B 19/00* (2013.01);
(Continued)

(58) Field of Classification Search
CPC ... B66D 1/36; B66D 1/38; B66D 1/40; B66D 1/46; B66D 1/48; B66D 1/485;
(Continued)

(56) References Cited

U.S. PATENT DOCUMENTS 2,502,710 A * 4/1950 Duncan ..... B66D 1/56 254/271
2,683,020 A * 7/1954 Nickle ..... E21B 19/02 254/271

(Continued)

FOREIGN PATENT DOCUMENTS

CN 106185624 A * 12/2016
KR 20120121546 11/2012

OTHER PUBLICATIONS

International Patent Application No. PCT/US2018/060712, International Search Report and Written Opinion dated Aug. 5, 2019, 13 pages.

*Primary Examiner* — Michael E Gallion
(74) *Attorney, Agent, or Firm* — Kilpatrick Townsend & Stockton LLP

(57) ABSTRACT

Systems and methods can be used in connection with a wellbore environment for automatically controlling wire being spooled around a drum. A system comprising a spooler, a sensor assembly, and a communication link can be used to adjust the position of wire being spooled around a drum. A first motor can control the spooler and a second motor can control the sensor assembly. The spooler can be positioned to control spooling of wire around the drum as the drum rotates to reel in wire. The sensor assembly can be configured to detect a distance between the sensor assembly and the wire being spooled. A communication link can communicatively couple the sensor assembly with the first motor and the second motor to control movement of the spooler and the sensor assembly relative to the drum based on the distance detected by the sensor assembly.

18 Claims, 6 Drawing Sheets

(51) Int. Cl.
*B65H 63/00* (2006.01)
*E21B 19/00* (2006.01)

(52) U.S. Cl.
CPC ..... *B65H 2553/81* (2013.01); *B65H 2701/36* (2013.01)

(58) Field of Classification Search
CPC .... B66D 1/60; B65H 63/003; B65H 2701/36; E21B 19/00
See application file for complete search history.

(56) References Cited

U.S. PATENT DOCUMENTS 4,132,387 A * 1/1979 Somerville ..... B66D 1/52 254/340
4,928,925 A * 5/1990 Christison ..... B63B 23/50 254/264
5,209,414 A * 5/1993 Clemens ..... B65H 54/10 242/478.2
5,310,125 A * 5/1994 Kitamura ..... H01F 41/064 242/447.2
5,551,644 A * 9/1996 Linderoth ..... B65H 54/286 242/478.2
6,135,421 A * 10/2000 Bartelme ..... B66D 1/56 254/268
6,443,431 B1 * 9/2002 Stasny ..... B66D 1/38 242/157.1
6,659,386 B1 * 12/2003 Rienas ..... G01B 11/105 242/478.2
6,811,112 B1 * 11/2004 Currie ..... B65H 54/2872 242/157.1
7,410,116 B2 * 8/2008 Planck ..... B65H 54/283 242/481
7,883,450 B2 * 2/2011 Hidler ..... A61H 3/008 482/69
8,141,260 B2 * 3/2012 Pellen ..... G01B 11/26 33/366.24
8,613,426 B1 * 12/2013 Holland ..... H02G 1/06 254/134.3 FT
9,908,756 B2 * 3/2018 Heravi ..... B66D 1/46
10,093,522 B1 * 10/2018 Baugh ..... B66D 1/38
10,358,317 B2 * 7/2019 Laird ..... B65H 75/4484
10,934,142 B2 * 3/2021 Hall ..... B66D 1/58
10,994,861 B2 * 5/2021 Espinosa-Sanchez ..... B65H 75/4415
11,124,394 B2 * 9/2021 Ou ..... B66D 1/38
2006/0192188 A1 * 8/2006 Sanders ..... B66D 1/54 254/361
2010/0294479 A1 * 11/2010 Shee ..... E21B 33/076 166/65.1
2012/0290226 A1 * 11/2012 Williams ..... G01L 5/108 702/41
2017/0088388 A1 3/2017 Lillich et al.

* cited by examiner

AUTOMATIC WIRE SPOOLING CONTROL

TECHNICAL FIELD

The present disclosure relates to devices usable in connection with a wellbore environment. More specifically, this disclosure relates to automatically controlling wire being spooled around a drum.

BACKGROUND

A wire can be spooled onto a drum as the drum rotates, for a variety of purposes including to extract downhole equipment from a wellbore. Spooling a wire onto a drum can involve the wire being positioned such that there are no gaps between each wrap around the drum and the direction of the wrap does not change before the spool flange is reached. Gaps between wraps or premature changes in direction can cause the wire to waste drum space, reduce durability of the wire from excess compressional stress due to uneven wraps, and cause the wire to be wedged, resulting in inability to unspool properly. These issues can occur when spooling is performed at increased rates. Spooling errors can also occur more often when the source of the wire, such as a bottom sheave, is not directly in line with the center of the wire reel. Spooling operations can be halted to remedy these errors, which can result in increased operation times and associated costs.

DETAILED DESCRIPTION

Figure 1:
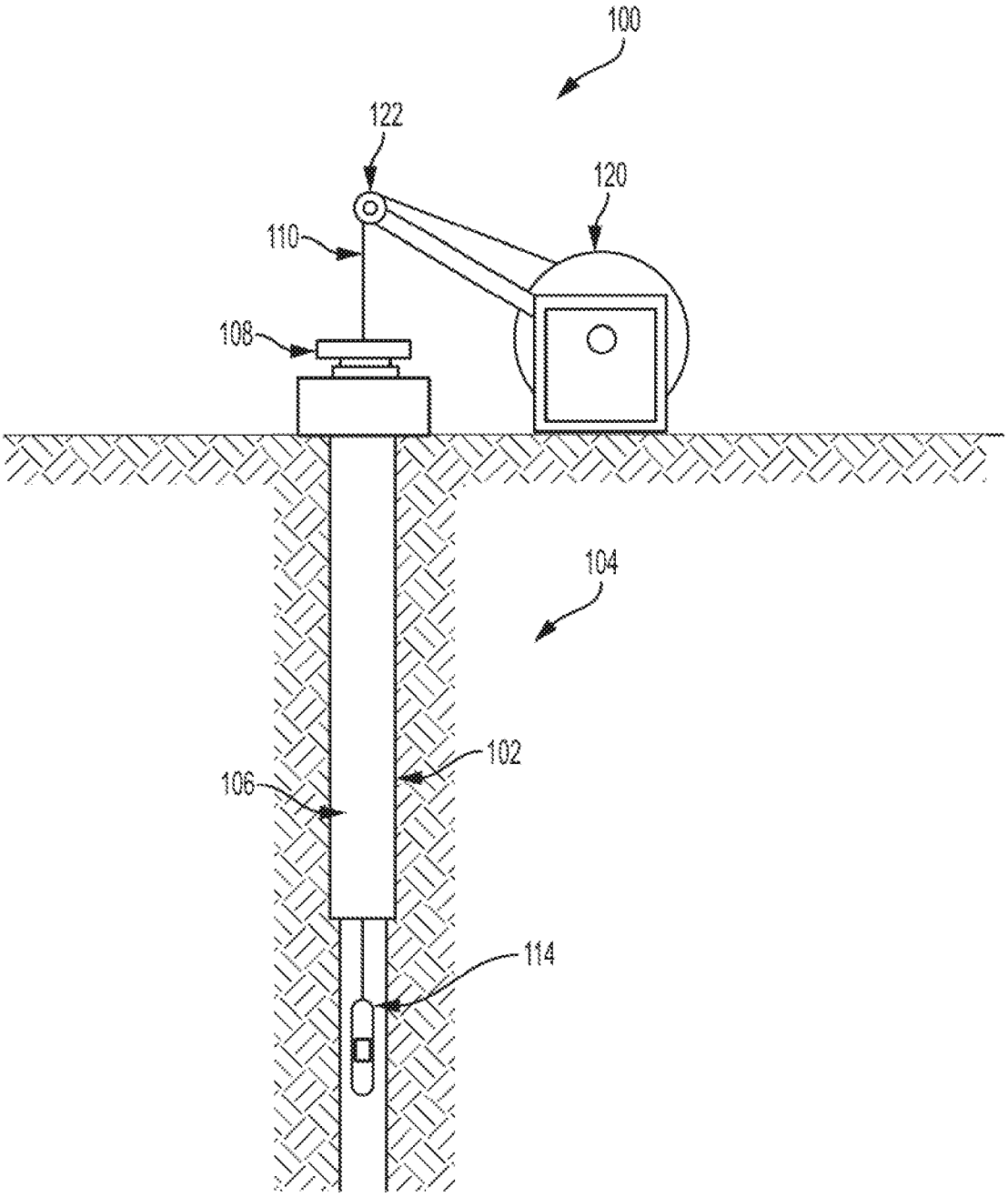
FIG. 1 is a cross-sectional view of an example of a wellbore environment suitable for using an automatic wire-spooling control system according to one aspect of the present disclosure.

Certain aspects and features relate to automatically controlling wire being spooled around a drum. A wire can be spooled onto a drum to reel in downhole equipment from within a wellbore. The wire may be very long, such as four to six miles long. As the wire is spooled onto the drum, the distance from the spooled wire relative to the height of the drum flange can change. Each wrap of the wire around the drum can reduce this distance by the diameter of the wire. The position of the wire being wrapped around the drum can be determined by monitoring the distance value using a sensor assembly. Based on the position of the wire, the sensor assembly can control a spooler to guide the wire precisely around the drum.

In some examples, the sensor assembly can move as the wire is being spooled onto the drum by tracking the edge of the wire (e.g., where the distance from the sensor to the wire changes). As the wire wraps around the drum, the sensor assembly can detect the edge of the wire where the wire is being spooled around a previously spooled layer of wire. The sensor assembly can be positioned along a guide rod located along the width of the drum using a motor. The position of the sensor assembly can be adjusted using the motor in response to the detected change in the distance to the wire. The sensor can communicate the adjusted position to a motor controlling a spooler positioned along another guide rod. The spooler can be controlled to move in tandem with the sensor assembly so that the wire is spooled perpendicular to the width of the drum. Spooling the wire straight onto the drum during the spooling process can reduce the number of spooling errors involving gaps or misdirected wraps.

In some examples, a sensor assembly can include an emitter and a sensor for determining the distance between the sensor assembly and the wire being spooled. The emitter can emit a type of energy that the sensor is receptive to after the energy interacts with the wire. The sensor assembly can determine the distance to the wire by analyzing the time is takes for the sensor to detect feedback energy (e.g., energy received in response to the energy emitted by the emitter. When the sensor detects a change in the distance, the position of the sensor assembly and the spooler can be adjusted to better align with the current spooling position.

When spooling a wire onto a drum, the wire should be positioned so there are no gaps between wraps around the drum and the direction of the wrap does not change before the drum flange is reached. Gaps and premature wrap direction changes can damage the wire and sometimes result in consecutive wraps being pinched between previous wrap layers, therefore causing problems in future unspooling operations. Incorrectly spooling a wire may cause damage to the wire such that the wire needs to be replaced, which can result in operations stoppage and increased non-productive time. Wellbore operational costs can increase when halting operations to address each spooling error by unspooling and re-spooling the wire more carefully, or by replacing a wire that is damaged beyond use. Automatic wire spooling according to some examples can reduce the chance for gaps and incorrect spooling direction changes to occur by precisely spooling a wireline by guiding the wire along the width of the drum using a spooler that can be positioned.

In some examples, the wire can be a wireline used to transmit and receive electrical signals with downhole equipment. Damage to the wireline from incorrect spooling may prevent the downhole equipment from communicating conditions of the wellbore to the surface. According to some examples, automatic wire spooling can reduce the risk for communication disconnections with downhole equipment caused by incorrect spooling.

Manual spooling can be a slow process that can involve a high level of supervision. Providing for automatically spooling wire can lower operational cost by reducing the number of wellbore engineers to operate production and operation wellbore phases. Automatic spooling according to some examples can further eliminate the risk of human error that may cause gaps and incorrect spooling direction changes resulting in overlapping. Also, automatic spooling can increase operating efficiency by spooling wire faster than manual spooling techniques.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional view a wellbore environment suitable for using an automatic wire-spooling control system according to one example. In the example shown in FIG. 1, the well system 100 includes a wellbore 102 extending through a hydrocarbon bearing subterranean formation 104. A casing string 106 (e.g., a metal casing) can extend from the well surface into the subterranean formation 104. The wellbore 102 may be created by drilling into the subterranean formation 104. A downhole tool 114 can be driven and can be positioned or otherwise arranged at the bottom of the wire 110 extended into the wellbore 102 arranged at a surface 108. The downhole tool 114 can be any equipment used in wellbore completion and production phases (e.g., perforating gun, wireline logging tools, etc.).

An automatic wire-spooling control system 120 may be located at the surface of the wellbore 102 to raise and lower the wire 110. The automatic wire-spooling control system 120 can include a spooler 122 to position the wire 110 for purposes of lowering and raising the wire 110 in the wellbore 102. The wire 110 can be any type of cabling used in wellbore environments (e.g., wireline, slickline, coiled tubing, braided cable, or any other form of conveyance that is spooled onto a drum or reel). The automatic wire-spooling control system 120 can be affixed to or a component of a truck assembly used to transport the wire 110. In some examples, the automatic wire-spooling control system 120 can be a transportable stand-alone system. The automatic wire-spooling control system 120 can include a drum (e.g., wireline reel) to store the wire 110 during and after the spooling process. The automatic wire-spooling control system 120 can move the downhole tool 114 axially within the wellbore 102 as attached to the wire 110. The automatic wire-spooling control system 120 can spool and unspool the length of the wire, which may be equivalent to miles of wire.

Figure 2:
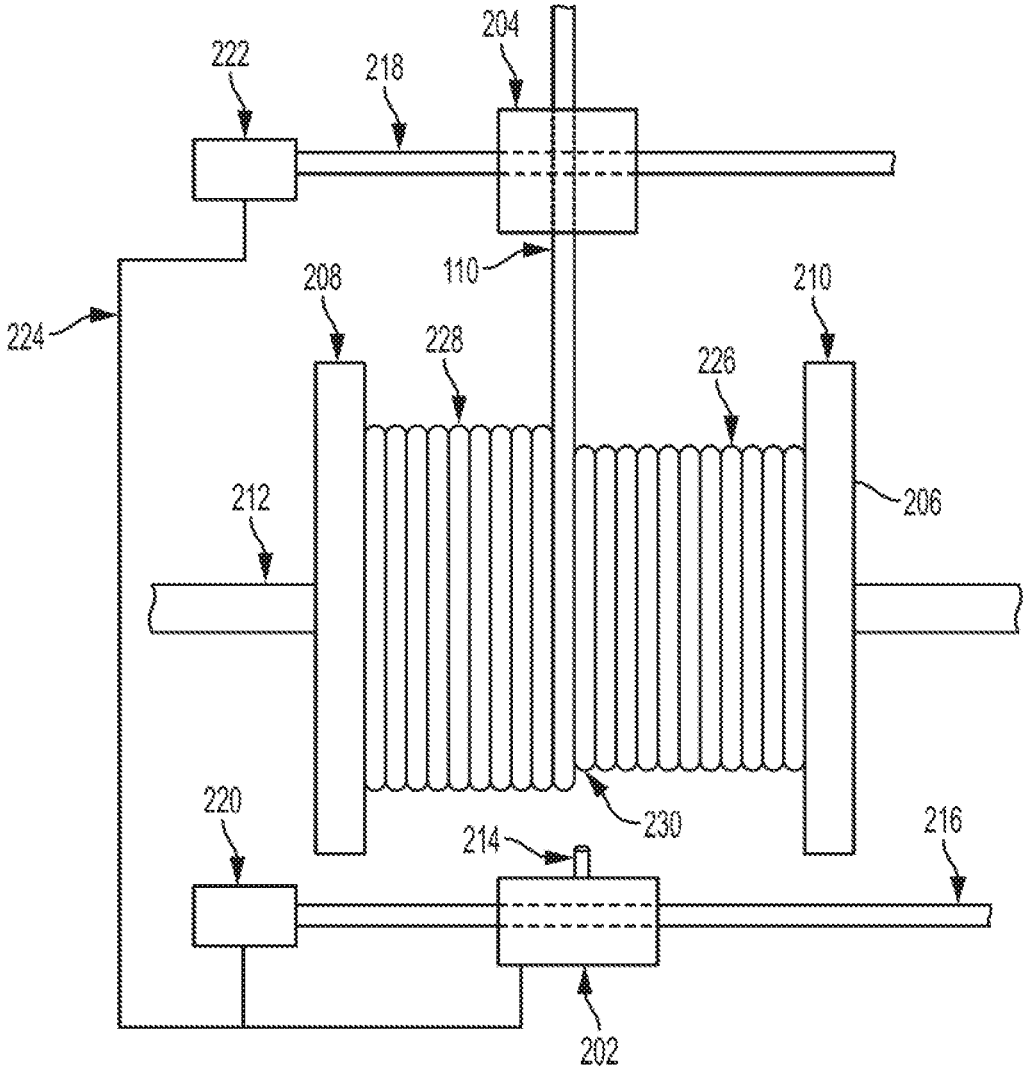
FIG. 2 is a schematic, cross-sectional top view of an example of an automatic wire-spooling control system according to one aspect of the present disclosure.

FIG. 2 is a schematic, cross-sectional top view of an automatic wire-spooling control system according to one example. The example in FIG. 2 shows a top view of an example of an automatic wire-spooling control system 120. The automatic wire-spooling control system 120 can include a sensor assembly 202, a spooler 204, and a drum 206. The sensor assembly 202 can be used to determine a spooling position at which the spooler 204 guides the wire 110 automatically onto the drum 206 in response to a distance change detected by the sensor assembly 202. The spooler 204 can be controlled to guide the wire 110 so that the wire 110 is wrapped around the drum 206 adjacent to a previous wrap of the wire 110. Precisely controlling the wrapping location of the wire 110 via the sensor assembly 202 and the spooler 204 can reduce the risk of gaps and premature spooling direction changes from occurring.

The drum 206 can be a spooling device such as a wireline reel or slickline reel that is rotatable using a drum axle 212. The drum 206 can be rotated via the drum axle 212 using a motor. The drum 206 can include a drum core for which the wire 110 can be wrapped around as the drum 206 is rotated. The drum 206 can have a drum flange 208 and a drum flange 210 on the ends of the drum 206 so that the wire 110 can be confined to a predetermined area when being spooled around the drum 206. The drum flange 208 and the drum flange 210 can be of a certain height so that the wire 110 does not extend beyond the edges of the drum flange 208 and the drum flange 210 when the wire 110 is fully spooled.

The sensor assembly 202 can include an emitter and a sensor useable to determine the distance between the sensor assembly 202 and the wire 110 that is spooled onto the drum 206. In the example in FIG. 2, the sensing device 214 can include a sensor and an emitter to perform both sensing and emitting functions. In other examples, the sensor assembly 202 can house separate sensor and emitting components. The emitter of the sensing device 214 can emit energy towards the wire 110. The energy emitted by the emitter of the sensing device 214 can result in a signal that is reflected by the wire 110 (e.g., feedback signal). The resulting signal can be received and measured by the sensor of the sensing device 214.

The sensor of the sensing device 214 can be optical, magnetic, acoustic, capacitive, or any other type of sensor useable to detect changes in distance based on reflected signal patterns. For example, the sensing device 214 can include an optical sensor and an infrared light emitter. The infrared light emitter can emit a focused beam onto the spool of the wire 110. The wire 110 can reflect the light, and the optical sensor can measure the light that is reflected. The sensor assembly 202 can determine the distance from the sensor assembly 202 to a top-most strand of the wire 110 based on the measured time between the emitter emitting energy and the sensor detecting the reflected energy.

For example, the base wrap, or first layer of the wire 110 wrapped around the drum axle 212, can be the starting point at the edge of the reel at either drum flange 208 or drum flange 210 where the wire 110 is spooled across and is level from one side to the other. As the wire 110 is wrapped around the drum 206, the wire 110 can be wrapped over the base wrap until the end of the drum 206 is reached. The next wrap initiating the next layer over the base wrap can then become the new base wrap. Calculating the distance to the wire 110 to determine the current position of the wrap and when a new base wrap is initiated can use signals transmitted from the sensing device 214. The signals can travel at the speed of sound, where the distance the signal travels can be calculated as:

$$D=V*T*0.5$$

D represents the distance between the sensing device 214 and the wire 110, such that the signal travels twice this distance, V represents velocity of the signal in the medium at the temperature measured, and T represents time for the sensing device 214 to emit the signal towards the wire 110 and then measure the feedback energy resulting from the interaction of the signal with the wire 110.

For example, in normal operating conditions, acoustic signals can have a velocity of 13.54 in/ms (0.344 m/ms). If the wire 110 has a diameter of 5/16 of an inch (7.94 mm) and the base wrap is 12 inches (0.3048 m) away from the sensing device 214, the time for the acoustic signal to travel from the sensing device 214 to the wire 110 and back to the sensing device 214 can be 1.772 ms. When the wire 110 moves across the drum 206 as the wire 110 is being spooled, a new wrap layer over the base wrap can be detected by the sensing device 214. Because the new wrap layer of the wire 110 is closer to the sensing device 214, the acoustic signal can be expected to return to the sensing device 214 faster as compared to detecting the distance to the underlying base wrap. In this example, the cable can be detected as being 11.6875 inches (0.2968 m) away from the sensing device 214. The new time corresponding to the new wrap layer can be measured as approximately 1.726 ms. Upon detecting a change in distance as determined by comparing signal travel times, the spooler 204 and the sensor assembly 202 can be repositioned until the travel time of consecutive signals was determined to be 1.722 ms as opposed to 1.726 ma (i.e., the sensing device 214 detects a transition point between the underlying base wrap and the newest wrap layer). The movement to reposition the spooler 204 and the sensor assembly 202 can be equal to the diameter of the cable being spooled. This detecting and repositioning process can continue until the end of the drum 206 is reached, at which time the spooling direction reverses and the new base wrap distance becomes the previous base wrap distance minus the diameter of the wire.

For the purposes of the aforementioned example, it can be assumed that the velocity of sound in air is approximately 331.3 m/s at 0 degrees Celsius ("C"), although the nominal operating temperature can be approximately 22 degrees C. In cases where the diameter of the wire 110 is smaller, a more precise measurement may be required and a proper correction for temperature can be performed. Determining velocity based on the speed of sound at various temperatures can be calculated as:

$$V_t\ (\text{m/s})=S+(0.606*T)$$

$$V_{ti}\ (\text{in/ms})=V_t*0.0397$$

S represents speed of sound at 0° C. (e.g., 331.3 m/s), T represents temperature in degrees C., $V_t$ represents temperature corrected velocity (m/s), and $V_{ti}$ represents temperature corrected velocity (in/ms).

In some examples using lasers or other light sources as part of the sensor assembly 202, a triangulation method could be used. A laser can be emitted and the signal reflected from the wire 110 can be measured at an angle. The measurement sensor can be a row of discrete photodetectors or other sensors to determine the position of the reflected source. As the distance between the source and the wire 110 changes, the reflected signal can move relative to the receiving sensor. As the reflected signal moves, the spooler 204 and sensor assembly 202 can be repositioned accordingly to keep the reflected beam in the center of the photodetector array.

In some examples, eddy current sensors can be used to create a magnetic field that can be directed at the wire 110. This magnetic field can create opposing magnetic fields and small currents in the base wrap of the wire 110. As the wire 110 is wrapped, the sensing device 214 can detect a change in the magnetic field corresponding to a change in a measureable voltage. The voltage is proportional to the distance between the sensing device 214 and the wire 110. A change in voltage can correspond to a change in distance from the sensing device 214 to the wire 110. In response to detecting a change in the distance to the wire 110, the spooler 204 and the sensor assembly 202 can be adjusted accordingly.

In the example shown in FIG. 2, the sensor assembly can be pointed at a sensing zone 230, where the wire 110 has not yet wrapped around the previous layer of wire. The previous layer 226 of the wire 110 can be a longer distance away from the top layer 228 of the wire 110. The difference between the distance from the sensor assembly 202 to the previous layer 226 and the distance from the sensor assembly 202 to the top layer 228 can be the diameter of the wire 110. As the wire 110 spools around the drum 206, the wire 110 can wrap around the location at which the sensor assembly 202 is detecting the distance to the wire 110. Once the wire 110 enters the sensing zone 230, the sensor assembly 202 can detect a change in the distance to the wire 110. In response to detecting a change in the distance to the wire 110, the position of the sensor assembly 202 can be adjusted in preparation of detecting the next change in distance resulting from the next wrap of the wire 110. For example, after detecting a change in the distance to the wire 110 in the sensing zone 230, the sensor assembly 202 can be adjusted to move in the direction of the spooling direction. In other words, the sensor assembly 202 can be positioned to move towards the previous layer 226, therefore shifting the sensing zone 230 from the top layer 228 to the previous layer 226.

The sensor assembly 202 can be positioned laterally across the width of the drum 206 so that the sensing device 214 can detect changes in distance to the wire 110 between the drum flange 208 and the drum flange 210. A motor 220 can shift the sensor assembly 202 laterally across a guide rod 216 to keep the sensing device 214 at the interface between the top layer 228 and the previous layer 226. The guide rod 216 can be threaded to allow the motor 220 to shift the sensor assembly 202 across the width of the drum 206.

The sensor assembly 202 can be communicatively coupled to the motor 220 by a communication link 224. The communication link 224 can allow the sensor assembly 202 to control the motor 220 to adjust the position of the sensor assembly 202 based on the change in the detected distance to the wire 110. The communication link can be any type of communication method for use in a wellbore environment (e.g., hardwired, serial, USB, fiber optic, etc.). In some examples, the communication link 224 may be implemented in the form of a wireless communication method (e.g., radio frequency, infrared, optical communications, BLE, etc.).

A spooler 204 can be used to guide the position of the wire 110 as the wire 110 is spooled around the drum 206. The spooler 204 can include a cavity for which the wire 110 can pass through the spooler 204 as the wire 110 is pulled from a wellbore. The spooler can be controlled to move in the desired spooling direction, from the top layer 228 towards the previous layer 226. A motor 222 can be used to position the spooler 204 laterally across the width of the drum 206 so that the spooler 204 can align with any location between the drum flange 208 and the drum flange 210. The motor 222 can shift the spooler 204 laterally across a guide rod 218 to position the spooler 204 across from the sensing zone 230. The guide rod 218 can be threaded to allow the motor 222 to shift the spooler 204.

The communication link 224 can communicatively couple the sensor assembly 202 to the motor 222. The communication link 224 can allow the sensor assembly 202 to control the motor 222 to adjust the position of the spooler 204 based on the change in the distance to the wire 110 detected by the sensor assembly 202. In some examples, the communication link 224 can allow for bidirectional communications between the motor 222 and the sensor assembly 202. Bidirectional communications can allow the motor 222 to communicate position data of the spooler 204 to the sensor assembly 202. For example, if the spooler 204 becomes jammed on the guide rod 218, the motor 222 can communicate the position error to the sensor assembly 202, so that the sensor assembly can take remedial action (e.g., halt spooling procedures so the spooler 204 may be fixed or replaced).

In some examples, the sensor assembly 202 and spooler 204 can move laterally relative to the drum 206 and parallel to the drum axle 212 so that the sensor assembly 202 and spooler 204 move simultaneously. For each revolution of the drum 206, a layer of the wire 110 can be wrapped around the drum 206 in a position relative to the spooler 204. When each layer of the wire 110 is spooled, the distance from the sensing device 214 of the sensor assembly 202 can decrease. The sensing device 214 can detect the decrease in distance, and then the sensor assembly 202 can move past the newly wrapped layer of the wire 110 to prepare to detect a next wrap adjacent to the newly wrapped layer. The sensor assembly 202 can control the spooler 204 by the communication link 224 to adjust the position of the spooler 204 based on the detected change in distance. The spooler 204 can move a distance laterally relative to the drum 206 that is equal to the distance moved by the sensor assembly 202. The adjustment to the position of the spooler 204 may lag slightly behind the adjustment to the position of the sensor assembly 202 by nature of the motor 222 having a longer communication pathway from the sensor assembly 202 through communication link 224 than the motor 220. The delay can be inconsequential and the spooler 204 can otherwise move with the sensor assembly 202 in real time.

The positions of the sensor assembly 202 and the spooler 204 can be adjusted continually via the motor 220, motor 222, and the communication link 224 to perform consecutive wraps wound around the drum 206 next to previous wraps. When the drum flange 208 or the drum flange 210 is reached, the sensor assembly 202 and the spooler 204 can reverse the spooling direction. For the example shown in FIG. 2, the sensor assembly 202 and the spooler 204 are spooling the wire 110 in the direction towards the drum flange 210. Once the wire 110 is spooled at the last possible location proximate to the drum flange 210 (e.g., the top layer 228 has covered the previous layer 226), the sensor assembly 202 and the spooler 204 can be positioned to reverse the spooling direction towards the drum flange 208. This can allow a new top layer to begin to be wrapped around the previous top layer 228.

The sensor assembly 202 can detect that the end of the drum 206 has been reached and that the wire 110 should be spooled in the opposite direction. In some examples, the sensor assembly 202 can detect that the end of the drum 206 has been reached by comparing a threshold position to the position at which the sensor assembly 202 is located. For example, the sensor assembly 202 can be programmed to move within a confined range along the guide rod 216. Once either end of that range is reached by the sensor assembly 202, the sensor assembly 202 can reverse direction, and cause the spooler direction to be reversed.

In some examples, the sensor assembly 202 can detect that the end of the drum has been reached by determining the distance from the sensor assembly 202 to the drum flange 210. For example, the drum flange 208 and the drum flange 210 can cause the sensor assembly to detect a distance that is much greater than a diameter of the wire 110. The sensor assembly 202 can determine that small distance to a drum flange is a different value than an expected change in distance caused by a wrapping of the wire 110. Upon sensing the smaller distance corresponding to the drum flange 208 or the drum flange 210, the sensor assembly 202 can shift movement direction and can control the spooler 204 to shift movement direction.

In other examples, the sensor assembly 202 can detect that the spooling direction should be adjusted using any combination of detecting a distance change from wire 110, detecting drum flange distance, and detecting an end position along a preset movement range on the guide rod 216.

In some examples, the motor 220 and the motor 222 can include circuitry to receive a notification from the sensor assembly 202 that the sensor assembly 202 detected a change in the distance to the wire 110. The communication link 224 can transceive position data of the sensor assembly 202 to the motor 220 and the motor 222. The circuitry of the motor 220 and the motor 222 can determine an adjustment distance based on the received notification that a change was detected, and then operate to shift the sensor assembly 202 and the spooler 204 appropriately.

In some examples, the motor 220 and the motor 222 can be located within or affixed to the sensor assembly 202 and the spooler 204 respectively. The motor 220 can be positioned within the housing of the sensor assembly 202 so that the motor 220 positions the sensor assembly on the guide rod 216 without use of the communication link 224. The motor 222 can be positioned in a spooler assembly including the spooler 204. The communication link 224 can communicatively couple the sensor assembly 202 to the spooler assembly including the motor 222 and the spooler 204. This configuration can reduce the number of external physical connections for communicating and performing adjustments in position to the sensor assembly 202 and the spooler 204.

A pivoting arm may be used in some examples in place of a guide rod. A pivoting arm may be used to adjust the position of the sensor assembly 202 or the spooler 204, such that the sensor assembly 202 and the spooler 204 are affixed to the pivoting arm. One or more pivoting arms can be used to shift the position of the sensor assembly 202 and the spooler 204 to guide the wire 110 along the drum 206.

In some examples, the mechanism for controlling the position of the spooler 204 and the sensor assembly 202 can be hydraulic mechanisms instead of motors. For example, a valve can be opened to apply hydraulic pressure to the side of the spooler 204 or sensor assembly 202 that is opposite of the spooling direction. Hydraulic pressure can be applied via a fluid conveyance line to either side of the spooler 204 or the sensor assembly 202 in order to control the spooling direction of the wire 110. Implementing hydraulic mechanisms to control spooling direction can operate similar to power steering systems in vehicles. Hydraulic mechanisms can be used when implementing pivoting arms or sliding guide rods as described in some examples.

The sensor assembly 202 can be used to determine the rate of spooling. For example, the rate of spooling can correspond to the speed at which downhole equipment is raised via the wire 110 from within a wellbore. The sensor assembly 202 can also be used during an unspooling configuration to determine the rate of unspooling. For example, the rate of unspooling can correspond to the speed at which downhole equipment is lowered into a wellbore. The spooling and unspooling rates can be used to compare against a threshold spooling rate or threshold unspooling rate. The spooling and unspooling rates can be determined by the time it takes for the sensing device 214 to detect a change in the distance to the wire 110 between each wrap. In other words, a faster spooling rate can correspond to the sensor assembly 202 moving faster along the guide rod 216 to keep up with the wrapping. Using the communication link 224, the sensor assembly 202 can be communicatively coupled to the drum motor or a separate system controlling the drum motor. The drum motor can be controlled to control the rate of spooling and unspooling in response to the spooling rate determined in real time. Controlling the drum 206 rotation rate which correlates to the spooling and unspooling rates can allow the sensor assembly 202 to maintain a constant spooling or unspooling rate.

Maintaining a controlled rate for lowering or raising downhole equipment can be useful during different phases of the spooling operation because there can otherwise be a difference in total length of the wire 110 being spooled or unspooled at different times throughout operation. For example, when the drum 206 is almost fully wrapped, the radial distance of the wire 110 from the drum axle 212 can be comparatively larger than the radial distance of the wire 110 from the drum axle 212 when the drum 206 is almost fully unspooled. One revolution of the drum 206 can unwind a greater length of the wire 110 than when unwinding one revolution where the drum 206 is almost fully unwound. Thus, the sensor assembly 202 may speed up or slow down the drum motor rotation rate to spool or unspool a certain length of the wire 110 within a given period. For example, because the length of wire 110 being unspooled can slow as the radial distance of the wire 110 from the drum axle 212 decreases, the sensor assembly 202 can control the drum motor to speed up the rotation of the drum 206 progressively to ensure any downhole equipment is being lowered at a constant rate. As another example, because the length of wire 110 being spooled can increase as the radial distance of the wire 110 from the drum axle 212 increases, the sensor assembly can control the drum motor to slow down the rotation of the drum 206 progressively to ensure any downhole equipment is being raised at a constant rate.

In some examples, the shift to the position of the sensor assembly 202 and spooler 204 can be a preset distance dependent upon the diameter of the wire 110. For example, the motor 220 and the motor 222 can shift the sensor assembly 202 and spooler 204 0.2 inches (5.08 mm) towards the spooling direction when the wire 110 is a 0.2-inch (5.08 mm) thick wireline. In some examples, the sensor assembly 202 and the spooler 204 can be shifted towards the spooling direction until the sensor assembly 202 detects a significant change in the distance to the wire 110. This process can involve the sensor assembly 202 scanning the distance to the wire 110 constantly as the sensor assembly 202 is shifted across the guide rod 216.

In some examples, the sensor assembly 202 can determine a starting point prior to beginning spooling operations. A starting point of the sensor assembly 202 can correspond to the location at which the top layer 228 meets the previous layer 226. By scanning the width of the drum 206, the sensor assembly 202 can be adjusted preemptively along the guide rod 216 to point the sensing device 214 at a sensing zone 230. Once the transition point between the top layer 228 and the previous layer 226 has been determined, the sensor assembly 202 can control the spooler 204 to be positioned across from the sensing zone 230. In some examples, the spooler 204 can move with the sensor assembly 202 as the sensor assembly 202 scans the drum 206 for a starting point. Positioning the sensor assembly 202 and spooler 204 automatically and correctly with respect to a starting point can ensure that no spooling errors occur during spooling startup. In some examples, for purposes of further automating spooling processes while providing additional safety, spooling operations may not be executable until the sensor assembly 202 and the spooler 204 have determined and been shifted to a starting point.

In some examples, the sensor assembly 202 can ignore slight dips in distance between consecutive wire wraps, where those dips are less than the diameter of the wire 110. For example, multiple wraps of a cylindrical wire around a drum where the wraps are positioned next to each other and touching can result in a spooled surface that is not flat. Crevices between the outermost points of each wrap can be a different spooled height than the outermost point of each wrap. The sensor assembly 202 may detect the changes in distance between the outermost points and the crevices, where these changes can be smaller than distance changes corresponding to appropriately spooled wraps. As such, to prevent the sensor assembly from shifting in response to detecting these smaller changes, the sensor assembly 202 can ignore the smaller changes and shift position in response to a change that is roughly equivalent to the diameter of the wire 110. Ignoring the smaller changes attributed to the curvature of the wire 110 can also be implemented when scanning the width of the drum 206 for a starting point according to some examples.

In some examples, the sensor assembly 202 may determine that a gap has occurred during the spooling process. If the sensor assembly 202 does not detect a change in the distance to the wire 110 after an estimated time to perform one wrap around the drum, the wire 110 may have been wrapped further along the drum 206 in the spooling direction than anticipated and out of detection range. The sensor assembly 202 may then perform one or more remedial operations in response to detecting a potential gap in the wire 110 being spooled. For example, the sensor assembly 202 may transmit an alert to a wellbore operator who may then halt the spooling process to rectify the error. In other examples, the sensor assembly 202 can issue a command to systems controlling the drum motor to halt all processes. In some fully automated examples, the sensor assembly 202 can halt all spooling operations upon detecting a gap, reverse the spooling direction to the point of error, and then re-spool the wire 110 appropriately.

When a wellbore operator is alerted to an error in the wire 110 being spooled, either through observation or through alert notification by the sensor assembly 202, the wellbore operator can issue a manual override. The wellbore operator may issue a manual override regardless of whether a spooling error has occurred (e.g., when the wire 110 reaches the end of the spooling or unspooling process to ensure the drum 206 is not overspun). Issuing a manual override can allow a wellbore operator to control the position of the spooler 204 manually by controlling the motor 222 to guide the wire 110 onto the drum 206. Manually controlling the spooler 204 can be performed independent of any commands issued by the sensor assembly 202 assuming the sensor assembly 202 remains active during the manual override. A wellbore operator can also manually adjust the position of the sensor assembly 202 and the spooler 204 to the designated starting point prior to initiating automatic wire spooling control.

Figure 3:
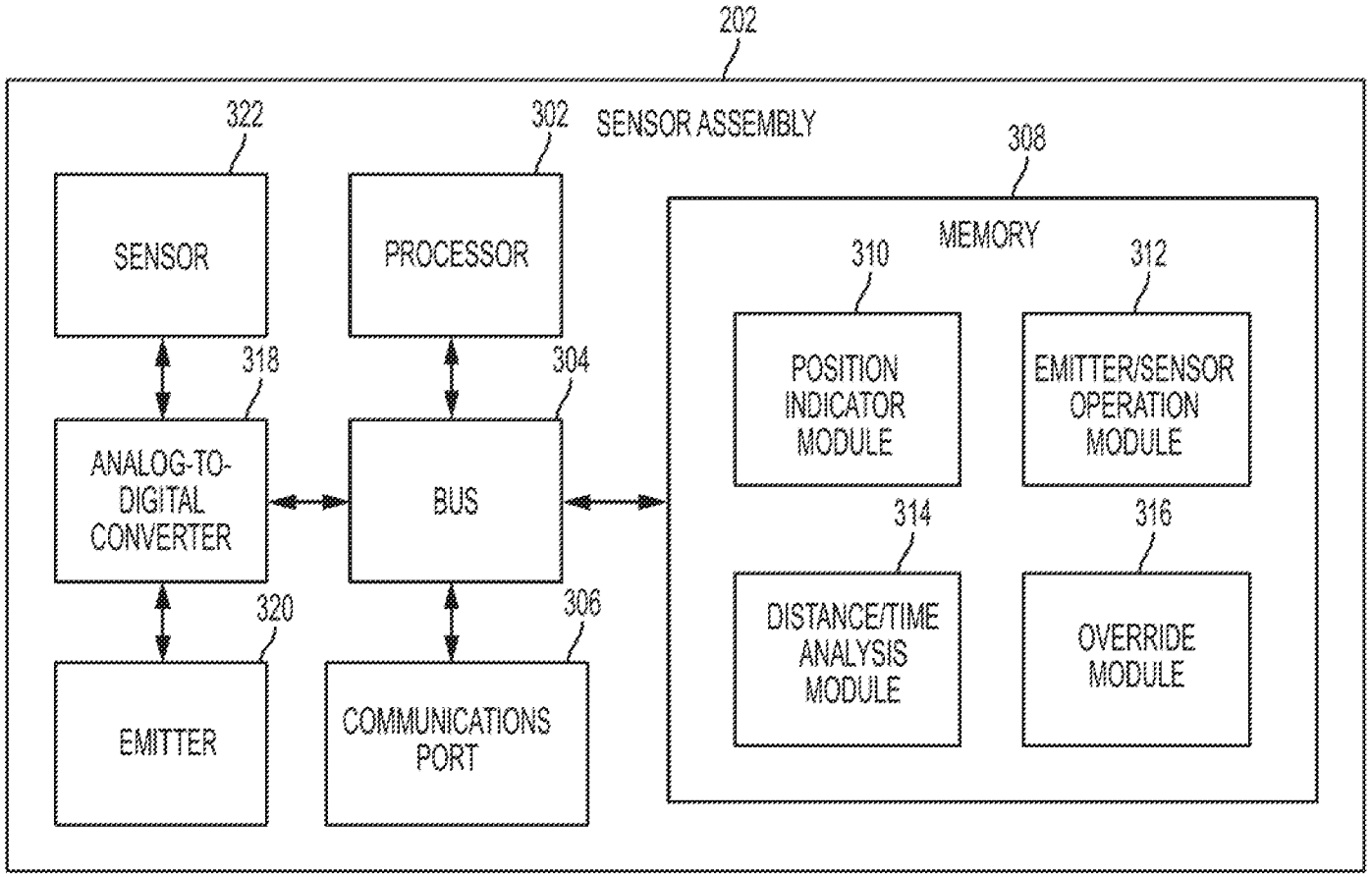
FIG. 3 is a block diagram of an example of a sensor assembly usable for executing program code for automatically spooling wire according to one aspect of the present disclosure.

FIG. 3 depicts a block diagram of a sensor assembly usable for executing program code for automatically spooling wire according to one example. The sensor assembly 202 can include a processor 302, a bus 304, a communications port 306, a memory 308, an analog-to-digital converter 318, an emitter 320, and a sensor 322. In some examples, the components shown in FIG. 3 (e.g., the processor 302, the bus 304, the communications port 306, the memory 308, the analog-to-digital converter 318, the emitter 320, and the sensor 322) can be integrated into a single structure. For example, the components can be within a single housing. In other examples, the components shown in FIG. 3 can be distributed (e.g., in separate housings) and in electrical communication with each other. The sensor 322 and emitter 320 can be separate components housed within the sensor assembly 202, as shown in FIG. 3, or can be components included in a single sensing device 214 as previously described.

The processor 302 can execute one or more operations for implementing some examples. The processor 302 can execute instructions stored in the memory 308 to perform the operations. The processor 302 can include one processing device or multiple processing devices. Non-limiting examples of the processor 302 include a Field-Programmable Gate Array ("FPGA"), an application-specific integrated circuit ("ASIC"), a microprocessor, etc.

The communication port 306 can be used to transceive any data according to the examples (e.g., transmitting instructions to control motors via a communication link, receiving instructions to enter an override configuration, etc.).

The processor 302 can be communicatively coupled to the memory 308 via the bus 304. The non-volatile memory 308 may include any type of memory device that retains stored information when powered off. Non-limiting examples of the memory 308 include electrically erasable and programmable read-only memory ("EEPROM"), flash memory, or any other type of non-volatile memory. In some examples, at least some of the memory 308 can include a medium from which the processor 302 can read instructions. A computer-readable medium can include electronic, optical, magnetic, or other storage devices capable of providing the processor 302 with computer-readable instructions or other program code. Non-limiting examples of a computer-readable medium include (but are not limited to) magnetic disk(s), memory chip(s), ROM, random-access memory ("RAM"), an ASIC, a configured processor, optical storage, or any other medium from which a computer processor can read instructions. The instructions can include processor-specific instructions generated by a compiler or an interpreter from code written in any suitable computer-programming language, including, for example, C, C++, C#, etc.

The emitter 320 can perform operations to emit energy for purposes of determining a physical distance to wire on a drum as described in some examples. According to some examples, the sensor 322 can perform operations to measure feedback energy in response to the emitter 320 emitting energy. The processor 302 can interface with the analog-to-digital converter 318 via the bus 304 to control the emitter 320 to emit energy. The sensor 322 can measure energy in analog form and relay the measured energy patterns to the analog-to-digital converter 318. The analog-to-digital converter 318 can convert the received analog signal into a digital format for processing by the processor 302 to determine the total time between emission and reception. After being converted from an analog format to a digital format by the analog-to-digital converter 318, time information can be stored in the memory 308 for further processing.

The memory 308 can include program code for a position indicator module 310, an emitter/sensor operation module 312, a distance/time analysis module 314, and an override module 316. The position indicator module 310 can determine the position of the sensor assembly 202 along a guide rod with respect to a drum. The position of the sensor assembly 202 as determined by the position indicator module can be used according to the functions of some examples. The emitter/sensor operation module 312 can control operations for the emitter 320 and the sensor 322, including determining the frequency at which the emitter 320 emits and the sensor 322 detects. The distance/time analysis module 314 can use the time information generated through use of the emitter/sensor operation module 312 to calculate a distance to the spool of wire. The emitter/sensor operation module 312 can scan the spool of wire constantly or at intervals for purposes of determining the distance to the wire using the distance/time analysis module 314. Measured distance values can be stored in the memory 308 and can be associated with a time stamp. When a newly scanned distance value is different from a recently stored distance value, the position indicator module 310 can adjust the position of the sensor assembly 202 depending on the range of the newly scanned distance value (e.g., different positioning operations can be performed when detecting a wire diameter versus detecting a distance to a drum flange). The override module 316 can receive an override command via the communications port 306 to halt automatic wire spooling operations performed by the various modules of the sensor assembly 202. The override module 316 can reinitiate automatic wire spooling operations after receiving an appropriate command through the communications port 306.

Figure 4:
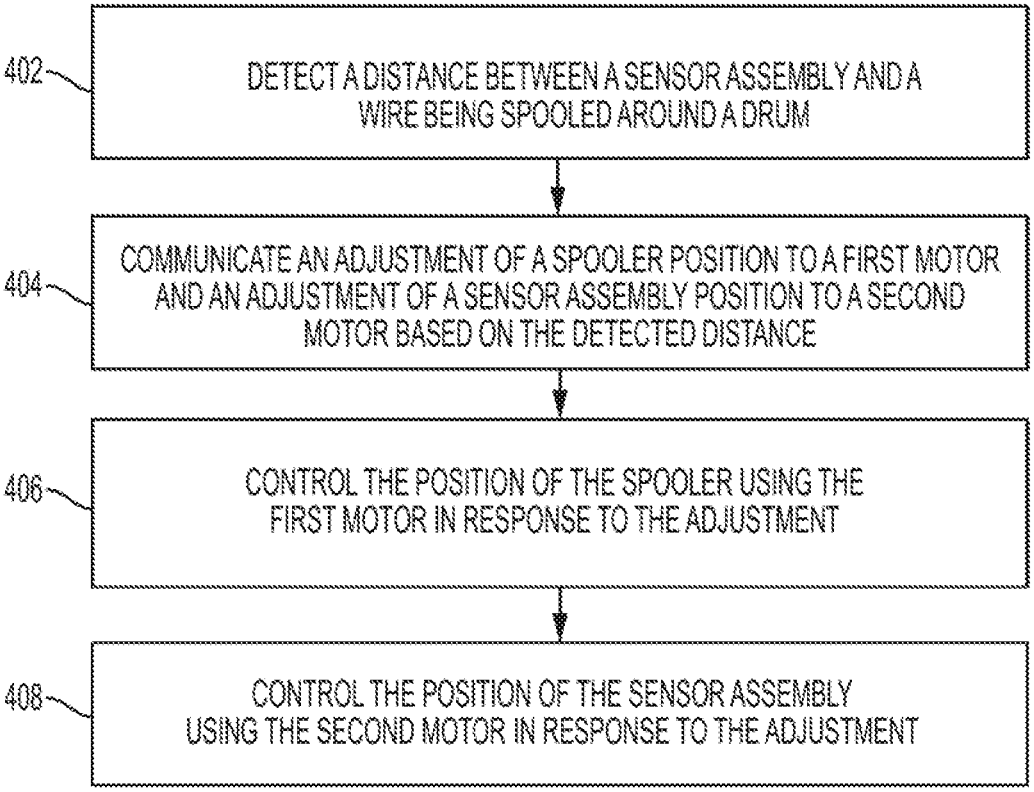
FIG. 4 is a flowchart of a process for automatically spooling wire according to one aspect of the present disclosure.

FIG. 4 is a flowchart of a process for automatically spooling wire according to one aspect of the present disclosure. Some processes for automatically spooling wire around a drum can be described according to previous examples. The processes described for automatically spooling wire can also be implemented in other environments besides wellbore environments.

In block 402, a distance between a sensor assembly and a wire being spooled around a drum is determined by the sensor assembly. The detected distance can be used to control the placement of wire being spooled around the drum by a spooler. The distance from the sensor assembly to the wire is determinable as a function of time based on the sensor assembly sensing energy in response to energy emitted previously.

In block 404, the sensor assembly communicates an adjustment to the position of a spooler to a first motor and an adjustment to the position of the sensor assembly to a second motor. The sensor assembly can transceive position data with the first motor and the second motor using a communication link. The position data transceived to the first motor from the sensor assembly can include a physical distance value and a direction value for adjusting the position of the spooler along a guide rod. The position data transceived to the second motor from the sensor assembly can include a physical distance value and a direction value for adjusting the position of the sensor assembly along another guide rod. For example, the position data can include instructions to control the first motor to adjust the spooler left along the guide rod by 0.3 inches (7.62 mm). As another example, the position data can include instructions to control the second motor to adjust the sensor assembly in right along the second guide rod by 0.15 inches (3.81 mm).

In some examples, the position data including physical adjustment amounts can be different as transmitted to the first motor and the second motor. For example, the adjustment amount to the spooler may be greater than the adjustment amount to the sensor assembly to correct the position of a spooler that is lagging behind the position of the sensor assembly. As such, the sensor assembly can transmit multiple different signals corresponding to various distance adjustments using the communication link. In some examples, the sensor assembly can transmit a burst signal or communication including position adjustments to control the first motor and the second motor, where the first motor and the second motor are able to identify the respective adjustments in the burst communication.

In block 406, the position of the spooler is controlled by the first motor. The first motor can move the spooler along the guide rod relative to the drum in response to the communication in block 404. The communication received by the first motor from the sensor assembly can include the adjustment of the spooler position. The first motor can interpret the communication and perform the adjustment to the position of the spooler. Adjusting the position of the spooler can cause the spooler to align the wire next to a previous wrap so that no gaps are created during the spooling process.

In block 408, the position of the sensor assembly is controlled by the second motor. The second motor can move the sensor assembly along the guide rod relative to the drum in response to the communication in block 404. The communication received by the second motor from the sensor assembly can include the adjustment of the sensor assembly position. The second motor can interpret the communication and perform the adjustment to the position of the sensor assembly. Adjusting the position of the sensor assembly can allow the sensor assembly to follow the wire as the wire is wrapped around the drum.

In some examples, the processes described in block 406 and block 408 can be performed substantially contemporaneously, such that the first motor and the second motor can adjust the positions of the spooler and the sensor assembly at relatively the same time (e.g., with minimal lag between adjusting the sensor assembly and adjusting the spooler). In some examples, the procedures described by blocks 402 through 408 can be performed simultaneously. For example, as the first motor and the second motor are shifting the position of the spooler and the sensor assembly to guide the position of the wire around the drum automatically, the sensor assembly can continue to detect distances to the wire. While the first motor and the second motor am still performing adjustments in response to a previously detected change in distance (e.g., a previous wrap), the sensor assembly can further communicate any adjustments to the first motor and the second motor that have not yet been performed.

Figure 5:
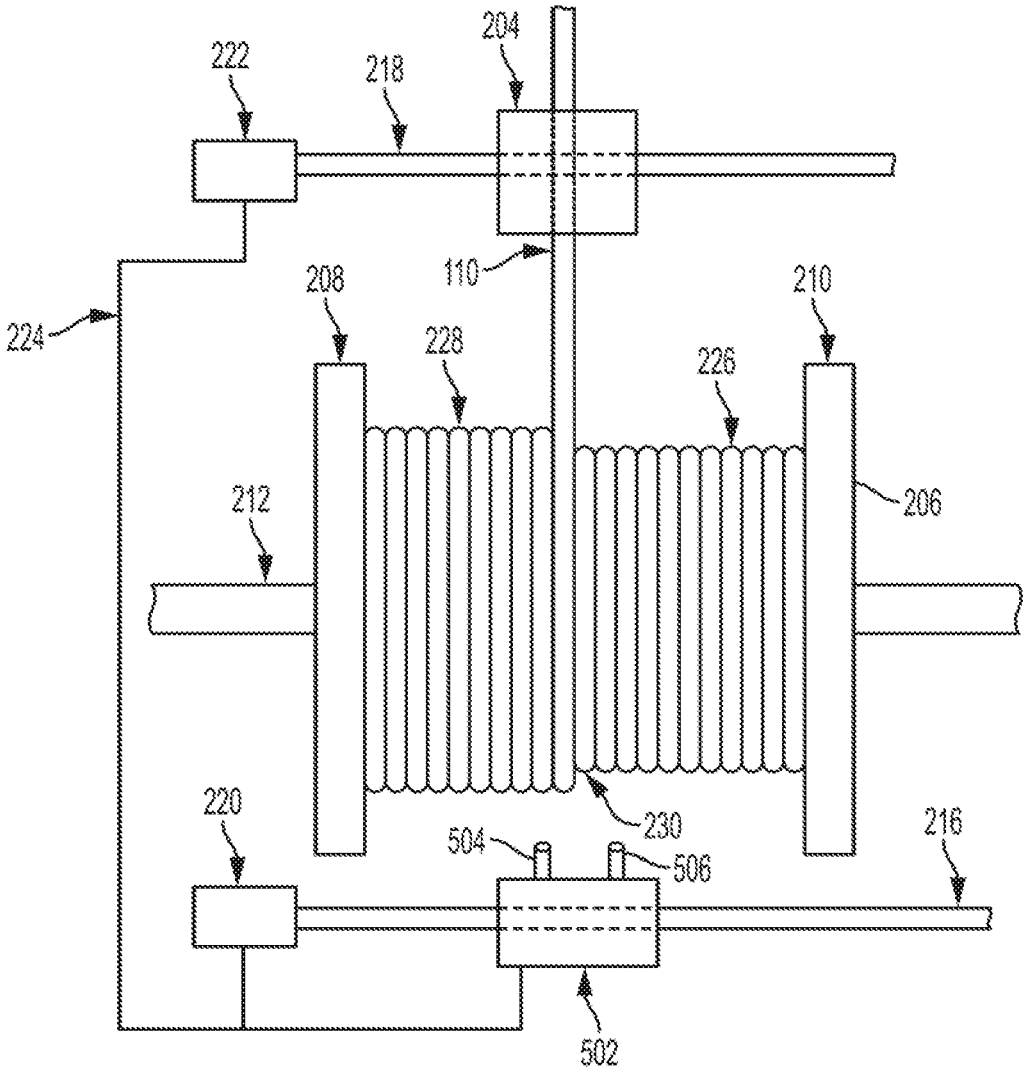
FIG. 5 is a schematic, cross-sectional top view of an example of an automatic wire-spooling control system with multiple sensing devices according to one aspect of the present disclosure.

FIG. 5 is a schematic, cross-sectional top view of an automatic wire-spooling control system with multiple sensing devices according to one example. A sensor assembly 502 can be similar to the sensor assembly 202 as previously described in some examples (e.g., FIG. 2). The sensor assembly 502 can include an additional sensing device as compared to previous examples. A sensing device 504 and a sensing device 506 can each have an emitter and a sensor to determine the distance to the wire 110 and discussed in previous examples. The sensing device 504 and the sensing device 506 can allow the sensor assembly 502 to detect a distance to the top layer 228 and a distance to the previous layer 226. Having a sensor assembly 502 with two sensing devices can allow for correlation of multiple data points that can be used to ensure the sensor assembly 502 and spooler 204 are positioned appropriately with respect to the wire 110 wrap. Two or more sensing devices can more precisely locate the appropriate sensing zone 230, which can result in higher confidence when determining an adjustment to the positions of the spooler 204 and the sensor assembly 502. Higher confidence in positioning the spooler 204 and the sensor assembly 502 can further reduce the risk of gaps and incorrect or premature spooling changes.

In some examples, the sensor assembly 502 can be replaced with a series of sensing devices across the length of the drum 206. The sensing devices could be positioned laterally across a bar in place of the guide rod 216, such that the total number of sensing devices can be used to determine the sensing zone 230 at the intersection of the top layer 228 with the previous layer 226 without having to move. At any given time, the series of sensing devices could determine multiple distances to the wire across the entire width of the drum 206. Thus, the motor 220 would not be needed to adjust the position of a sensor assembly to follow the wrapping of the wire 110 around the drum 206. This can reduce necessary communications to transmit or receive position information with the motor 222 via the communication link 224. This configuration may reduce cost by eliminating the need for a motor and may further reduce error by reducing the number of moving parts.

Figure 6:
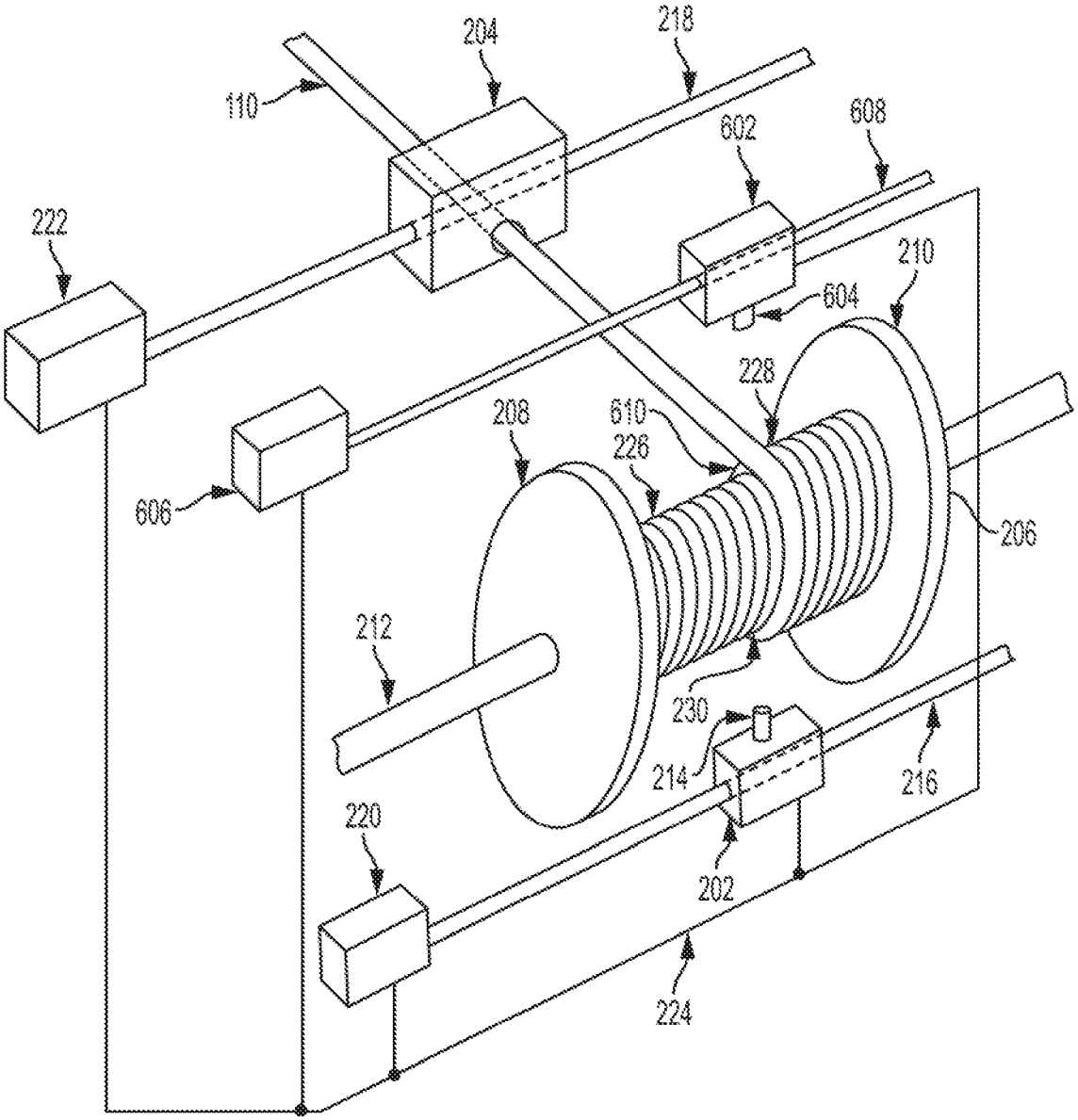
FIG. 6 is a perspective view of an example of an automatic wire-spooling control system with two sensor assemblies according to one aspect of the present disclosure.

FIG. 6 is a perspective view of an automatic wire-spooling control system with two sensor assemblies according to one example. In some examples, the sensor assembly 202 and corresponding components can be duplicated to position a second identical sensor assembly and corresponding components at another location around the drum 206. For example, the sensor assembly 202 can be positioned beneath the drum 206 to detect changes in distance to the wire 110 along the bottom of the spool. The sensor assembly 202 can function according to the previously described examples to automatically spool wire around the drum using the spooler 204 and various motors. An additional sensor assembly 602 can be positioned above the drum 206. The sensor assembly 602 can include a sensing device 604 equivalent in structure and function to the sensing device 214. The sensing device 604 can be used to detect a transition from the previous layer 226 to the top layer 228 at a sensing zone 610. Based on the detected change in distance to the wire 110 at the sensing zone 610, the sensor assembly 602 can communicate an adjustment to the positon of the sensor assembly 602 to the motor 606. In response to receiving the communication from the sensor assembly 602, the motor 606 can perform an adjustment to the positon of the sensor assembly 602. The motor 606 can position the sensor assembly 602 laterally along a guide rod 608.

The communication link 224 can communicatively couple the sensor assembly 602 to the sensor assembly 202, the motor 220, the motor 222, and the motor 606. In other examples, the distance data measured by the sensor assembly 202 and the sensor assembly 602 can be communicated to a separate control system via the communication link 224 to allow the separate control system to issue commands to each motor.

The spooler can be positioned along the guide rod 218 based on the detected changes determined by the sensor assembly 202 and the sensor assembly 602. For example, as the wire 110 wraps around the drum, the sensor assembly 602 can detect a change in the distance to the wire 110 before the sensor assembly 202 can detect a change in the distance to the wire 110. When the sensor assembly 602 first detects a distance change, the sensor assembly 602 can communicate an adjustment to the position of the spooler 204 to the motor 222, controlling the spooler 204 to shift over slightly. When the sensor assembly 202 detects a distance change, sensor assembly 202 can communicate an adjustment to the position of the spooler 204 to the motor 222, controlling the spooler 204 to further shift over slightly. Shifting the spooler 204 in smaller increments as a result of implementing two-sensor assembly within a single system can allow for more precise movements of the spooler 204. More precise adjustments to the position of the spooler 204 can further reduce the risk of creating gaps or premature or incorrect spooling direction changes. A multiple sensor assembly configuration can also allow for redundancy of the sensor assembly in case of failure of one of the sensor assemblies. For example, if the sensor assembly 202 fails, the sensor assembly 602 can perform operations as described by previous examples while the sensor assembly 202 is replaced or repaired.

As used below, any reference to a series of examples is to be understood as a reference to each of those examples disjunctively (e.g., "Examples 1-4" is to be understood as "Examples 1, 2, 3, or 4").

In some aspects, systems, devices, and methods for automatically controlling wire being spooled around a drum are provided according to one or more of the following examples:

Example 1 is a system comprising: a spooler controllable by a first motor to control spooling of wire around a drum; a sensor assembly controllable by a second motor to detect a distance between the sensor assembly and the wire being spooled; and a communication link for communicatively coupling the sensor assembly with the first motor and the second motor to control movement of the spooler and the sensor assembly relative to the drum based on the distance.

Example 2 is the system of example 1, wherein the first motor is useable to position the spooler laterally across a width of the drum, and the second motor is useable to position the sensor assembly laterally across the width of the drum, and wherein positioning the spooler is performed substantially contemporaneously to positioning the sensor assembly.

Example 3 is the system of any of examples 1 to 2, wherein the sensor assembly further comprises: an emitter to emit energy towards the wire; and a sensor to detect feedback energy from the energy emitted from the emitter interacting with the wire to detect the distance by measuring a time between the emitter emitting the energy and the sensor detecting the feedback energy.

Example 4 is the system of any of examples 1 to 3, wherein the spooler is controllable by the first motor and the sensor assembly is controllable by the second motor to move in a spooling direction of the wire being spooled in response to a change in the distance.

Example 5 is the system of any of examples 1 to 4, wherein the first motor is controllable by an override setting to allow for manual control of the spooler and prevent control of the spooler by the distance detected by the sensor assembly.

Example 6 is the system of any of examples 1 to 5, further comprising a second sensor assembly to detect a second distance between the second sensor assembly and the wire being spooled, the distance and the second distance being measureable at different locations around the drum.

Example 7 is the system of any of examples 1 to 6, wherein the sensor assembly includes a sensor that is an optical sensor, a magnetic sensor, an acoustic sensor, or a capacitive sensor.

Example 8 is the system of any of examples 1 to 7, wherein the first motor is located within the spooler and the second motor is located within the sensor assembly.

Example 9 is a sensor assembly comprising: an emitter to emit energy towards a wire being spooled around a drum; and a sensor to detect a distance between the sensor assembly and the wire by measuring a time between the emitter emitting the energy and the sensor detecting feedback energy from the energy emitted by the emitter interacting with the wire, wherein a communication link for communicatively coupling the sensor assembly with a first motor and a second motor is useable to control movement of (i) a spooler by the first motor to control spooling of wire around the drum, and (ii) the sensor assembly by the second motor, wherein the movement is relative to the drum based on the distance.

Example 10 is the sensor assembly of example 9, wherein the first motor is useable to position the spooler laterally across a width of the drum, and the second motor is useable to position the sensor assembly laterally across the width of the drum, and wherein positioning the spooler is performed substantially contemporaneously to positioning the sensor assembly.

Example 11 is the sensor assembly of any of examples 9 to 10, wherein the spooler is controllable by the first motor and the sensor assembly is controllable by the second motor to move in a spooling direction of the wire being spooled in response to a change in the distance.

Example 12 is the sensor assembly of any of examples 9 to 11, wherein the first motor is controllable by an override setting to allow for manual control of the spooler and prevent control of the spooler by the distance detected by the sensor assembly.

Example 13 is the sensor assembly of any of examples 9 to 12, wherein the sensor is an optical sensor, a magnetic sensor, an acoustic sensor, or a capacitive sensor.

Example 14 is the sensor assembly of any of examples 9 to 13, wherein the first motor is located within the spooler and the second motor is located within the sensor assembly.

Example 15 is a method comprising: detecting, by a sensor assembly, a distance between the sensor assembly and a wire being spooled around a drum for purposes of controlling spooling of the wire around the drum by a spooler; communicating, by a communication link from the sensor assembly, an adjustment of a spooler position to a first motor and an adjustment of a sensor assembly position to a second motor, the adjustment of the spooler position and the sensor assembly position being based on the distance, wherein the communication link communicatively couples the sensor assembly to the first motor and the second motor, controlling, by the first motor, the spooler position relative to the drum in response to the adjustment of the spooler position; and controlling, by the second motor, the sensor assembly position relative to the drum in response to the adjustment of the sensor assembly position.

Example 16 is the method of example 15, wherein controlling the spooler position and controlling the sensor assembly position further include positioning the spooler and the sensor assembly laterally across a width of the drum, wherein positioning the spooler is performed substantially contemporaneously to positioning the sensor assembly.

Example 17 is the method of any of examples 15 to 16, further comprising: emitting, by an emitter of the sensor assembly, energy towards the wire; and detecting, by a sensor of the sensor assembly, feedback energy from the energy emitted from the emitter interacting with the wire; measuring, by the sensor assembly, a time between the emitter emitting the energy and the sensor detecting the feedback energy; and determining, by the sensor assembly, the distance between the sensor assembly and the wire being spooled based on the time.

Example 18 is the method of any of examples 15 to 17, wherein the spooler is controllable by the first motor and the sensor assembly is controllable by the second motor to move in a spooling direction of the wire being spooled in response to a change in the distance.

Example 19 is the method of any of examples 15 to 18, further comprising: detecting, by a second sensor assembly, a second distance between the second sensor assembly and the wire being spooled, the distance and the second distance being measured at different locations around the drum.

Example 20 is the method of any of examples 15 to 19, wherein the sensor assembly includes a sensor that is an optical sensor, a magnetic sensor, an acoustic sensor, or a capacitive sensor.

Example 21 is a sensor assembly comprising: an emitter to emit energy towards a wire being spooled around a drum; and a sensor to detect a distance between the sensor assembly and the wire by measuring a time between the emitter emitting the energy and the sensor detecting feedback energy from the energy emitted by the emitter interacting with the wire, wherein a communication link for communicatively coupling the sensor assembly with a first motor and a second motor is useable to control movement of (i) a spooler by the first motor to control spooling of wire around the drum, and (ii) the sensor assembly by the second motor, wherein the movement is relative to the drum based on the distance.

Example 22 is the sensor assembly of example 21, wherein the first motor is useable to position the spooler laterally across a width of the drum, and the second motor is useable to position the sensor assembly laterally across the width of the drum, and wherein positioning the spooler is performed substantially contemporaneously to positioning the sensor assembly.

Example 23 is the sensor assembly of any of examples 21 to 22, wherein the spooler is controllable by the first motor and the sensor assembly is controllable by the second motor to move in a spooling direction of the wire being spooled in response to a change in the distance.

Example 24 is the sensor assembly of any of examples 21 to 23, wherein the first motor is controllable by an override setting to allow for manual control of the spooler and prevent control of the spooler by the distance detected by the sensor assembly.

Example 25 is the sensor assembly of any of examples 21 to 24, wherein the sensor is an optical sensor, a magnetic sensor, an acoustic sensor, or a capacitive sensor.

Example 26 is the sensor assembly of any of examples 21 to 25, wherein the first motor is located within the spooler and the second motor is located within the sensor assembly.

Example 27 is the sensor assembly of any of examples 21 to 26, wherein the sensor assembly is in a system that comprises: the spooler; and the communication link.

Example 28 is the sensor assembly of example 27, wherein the system further comprises: a second sensor assembly to detect a second distance between the second sensor assembly and the wire being spooled, the distance and the second distance being measureable at different locations around the drum.

Example 29 is a method comprising: detecting, by a sensor assembly, a distance between the sensor assembly and a wire being spooled around a drum for purposes of controlling spooling of the wire around the drum by a spooler; communicating, by a communication link from the sensor assembly, an adjustment of a spooler position to a first motor and an adjustment of a sensor assembly position to a second motor, the adjustment of the spooler position and the sensor assembly position being based on the distance, wherein the communication link communicatively couples the sensor assembly to the first motor and the second motor; controlling, by the first motor, the spooler position relative to the drum in response to the adjustment of the spooler position; and controlling, by the second motor, the sensor assembly position relative to the drum in response to the adjustment of the sensor assembly position.

Example 30 is the method of example 29, wherein controlling the spooler position and controlling the sensor assembly position further include positioning the spooler and the sensor assembly laterally across a width of the drum, wherein positioning the spooler is performed substantially contemporaneously to positioning the sensor assembly.

Example 31 is the method of any of examples 29 to 30, further comprising: emitting, by an emitter of the sensor assembly, energy towards the wire; and detecting, by a sensor of the sensor assembly, feedback energy from the energy emitted from the emitter interacting with the wire; measuring, by the sensor assembly, a time between the emitter emitting the energy and the sensor detecting the feedback energy; and determining, by the sensor assembly, the distance between the sensor assembly and the wire being spooled based on the time.

Example 32 is the method of any of examples 29 to 31, wherein the spooler is controllable by the first motor and the sensor assembly is controllable by the second motor to move in a spooling direction of the wire being spooled in response to a change in the distance.

Example 33 is the method of any of examples 29 to 32, further comprising: detecting, by a second sensor assembly, a second distance between the second sensor assembly and the wire being spooled, the distance and the second distance being measured at different locations around the drum.

Example 34 is the method of any of examples 29 to 33, wherein the sensor assembly includes a sensor that is an optical sensor, a magnetic sensor, an acoustic sensor, or a capacitive sensor.

Example 35 is the method of any of examples 29 to 34, wherein the first motor is located within the spooler and the second motor is located within the sensor assembly.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a spooler controllable by a first motor to control spooling of wire around a drum;

a sensor assembly controllable by a second motor to detect a distance between the sensor assembly and the wire being spooled; and a communication link for communicatively coupling the sensor assembly with the first motor and the second motor to control movement of the spooler and the sensor assembly relative to the drum based on the distance; wherein the first motor is useable to position the spooler laterally across a width of the drum, and the second motor is useable to position the sensor assembly laterally across the width of the drum, and wherein positioning the spooler is performed substantially contemporaneously to positioning the sensor assembly.

2. The system of claim 1, wherein the sensor assembly further comprises:

an emitter to emit energy towards the wire; and a sensor to detect feedback energy from the energy emitted from the emitter interacting with the wire to detect the distance by measuring a time between the emitter emitting the energy and the sensor detecting the feedback energy.

3. The system of claim 1, wherein the spooler is controllable by the first motor and the sensor assembly is controllable by the second motor to move in a spooling direction of the wire being spooled in response to a change in the distance.

4. The system of claim 1, wherein the first motor is controllable by an override setting to allow for manual control of the spooler and prevent control of the spooler by the distance detected by the sensor assembly.

5. The system of claim 1, further comprising a second sensor assembly to detect a second distance between the second sensor assembly and the wire being spooled, the distance and the second distance being measureable at different locations around the drum.

6. The system of claim 1, wherein the sensor assembly includes a sensor that is an optical sensor, a magnetic sensor, an acoustic sensor, or a capacitive sensor.

7. The system of claim 1, wherein the first motor is located within the spooler and the second motor is located within the sensor assembly.

8. A sensor assembly comprising:

an emitter to emit energy towards a wire being spooled around a drum; and a sensor to detect a distance between the sensor assembly and the wire by measuring a time between the emitter emitting the energy and the sensor detecting feedback energy from the energy emitted by the emitter interacting with the wire, wherein a communication link for communicatively coupling the sensor assembly with a first motor and a second motor is useable to control movement of (i) a spooler by the first motor to control spooling of wire around the drum, and (ii) the sensor assembly by the second motor, wherein the movement is relative to the drum based on the distance; wherein the first motor is useable to position the spooler laterally across a width of the drum, and the second motor is useable to position the sensor assembly laterally across the width of the drum, and wherein positioning the spooler is performed substantially contemporaneously to positioning the sensor assembly.

9. The sensor assembly of claim 8, wherein the spooler is controllable by the first motor and the sensor assembly is controllable by the second motor to move in a spooling direction of the wire being spooled in response to a change in the distance.

10. The sensor assembly of claim 8, wherein the first motor is controllable by an override setting to allow for manual control of the spooler and prevent control of the spooler by the distance detected by the sensor assembly.

11. The sensor assembly of claim 8, wherein the sensor is an optical sensor, a magnetic sensor, an acoustic sensor, or a capacitive sensor.

12. The sensor assembly of claim 8, wherein the first motor is located within the spooler and the second motor is located within the sensor assembly.

13. A method comprising:

detecting, by a sensor assembly, a distance between the sensor assembly and a wire being spooled around a drum for purposes of controlling spooling of the wire around the drum by a spooler;

communicating, by a communication link from the sensor assembly, an adjustment of a spooler position to a first motor and an adjustment of a sensor assembly position to a second motor, the adjustment of the spooler position and the sensor assembly position being based on the distance, wherein the communication link communicatively couples the sensor assembly to the first motor and the second motor;

controlling, by the first motor, the spooler position relative to the drum in response to the adjustment of the spooler position; and controlling, by the second motor, the sensor assembly position relative to the drum in response to the adjustment of the sensor assembly position.

14. The method of claim 13, wherein controlling the spooler position and controlling the sensor assembly position further include positioning the spooler and the sensor assembly laterally across a width of the drum, wherein positioning the spooler is performed substantially contemporaneously to positioning the sensor assembly.

15. The method of claim 13, further comprising:

emitting, by an emitter of the sensor assembly, energy towards the wire; and detecting, by a sensor of the sensor assembly, feedback energy from the energy emitted from the emitter interacting with the wire;

measuring, by the sensor assembly, a time between the emitter emitting e energy and the sensor detecting the feedback energy; and determining, by the sensor assembly, the distance between the sensor assembly and the wire being spooled based on the time.

16. The method of claim 13, wherein the spooler is controllable by the first motor and the sensor assembly is controllable by the second motor to move in a spooling direction of the wire being spooled in response to a change in the distance.

17. The method of claim 13, further comprising:

detecting, by a second sensor assembly, a second distance between the second sensor assembly and the wire being spooled, the distance and the second distance being measured at different locations around the drum.

18. The method of claim 13, wherein the sensor assembly includes a sensor that is an optical sensor, a magnetic sensor, an acoustic sensor, or a capacitive sensor.

* * * * *